US006510560B1

(12) United States Patent
Ugolnik

(10) Patent No.: US 6,510,560 B1
(45) Date of Patent: Jan. 28, 2003

(54) ROLLER-SUIT AND APPAREL

(76) Inventor: Adam Ugolnik, 22-30 42nd St., Apt. 3F, Astoria, NY (US) 11105

( * ) Notice: Subject to any disclaimer, the term of this patent is extended or adjusted under 35 U.S.C. 154(b) by 0 days.

(21) Appl. No.: 09/414,158

(22) Filed: Oct. 8, 1999

(51) Int. Cl.[7] ..... A41D 13/00
(52) U.S. Cl. ..... 2/455; 2/22
(58) Field of Search ..... 2/455, 456, 463, 2/467, 16, 22, 23, 24, 464, 69, 102, 158, 159, 160, 911; 280/32.5, 32.6, 7.15, 11.19, 7.11, 87.021, 87.01, 87.03, 87.041, 87.04

(56) References Cited

U.S. PATENT DOCUMENTS

| | | | | | |
|---|---|---|---|---|---|
| 1,547,166 | A | * | 7/1925 | Davidson | 2/24 |
| 2,130,439 | A | * | 9/1938 | Wheeler | 2/455 |
| 2,448,427 | A | * | 8/1948 | Gordon | 2/24 |
| 2,484,494 | A | | 10/1949 | Ferguson | |
| 4,413,832 | A | * | 11/1983 | Pendleton | 280/845 |
| 4,688,269 | A | | 8/1987 | Maeshima | |
| 4,747,470 | A | | 5/1988 | Fernandez | |
| 4,810,559 | A | * | 3/1989 | Fortier et al. | |
| 4,879,765 | A | | 11/1989 | Bailie et al. | |
| 4,892,305 | A | | 1/1990 | Lynch | |
| 5,373,584 | A | * | 12/1994 | Parcells, III | 2/465 |
| 5,581,805 | A | | 12/1996 | Rennick | |
| D378,469 | S | | 3/1997 | Tremblay | |
| 5,623,729 | A | | 4/1997 | Chen | |
| 5,725,224 | A | * | 3/1998 | Kerr | 280/11.19 |
| 5,794,275 | A | | 8/1998 | Donzis | |
| 5,829,057 | A | | 11/1998 | Gunn | |
| 5,867,826 | A | | 2/1999 | Wilkinson | |
| 5,870,774 | A | | 2/1999 | Legenstein | |
| 5,926,857 | A | * | 7/1999 | Blondeau | 2/456 |
| 5,937,440 | A | * | 8/1999 | Ferriter | 2/24 |

FOREIGN PATENT DOCUMENTS

| | | |
|---|---|---|
| GB | 2 233 877 | 1/1991 |
| WO | WO90/03126 | 4/1990 |

* cited by examiner

*Primary Examiner*—Gloria M. Hale
(74) *Attorney, Agent, or Firm*—Tony A. Gayoso

(57) ABSTRACT

A body roller suit (1) containing a plurality of rollers (20) wherein a wearer's body can roll along the ground or other surface. More particularly, the body roller suit contains a distribution of rollers (20) such that a wearer lying on a surface would be supported entirely by rollers (20). Additional apparel and equipment can be worn for safety and control while using the body roller suit (1). The invention further relates to methods for producing a roller suit (1).

15 Claims, 22 Drawing Sheets

Front View

Front View

Back View

Front View

Back View

ROLLER-SUIT AND APPAREL

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF THE INVENTION

The invention relates generally to apparel and equipment worn to provide rolling surfaces over a plurality of areas of a user's body and additional apparel providing protection and frictional surfaces for directing, producing, retarding or stopping motion.

BACKGROUND OF THE INVENTION

Very often particular apparel or equipment is worn in order to enhance the performance of certain tasks. For example, many athletes wear clothing that is designed to reduce drag coefficients, such as swimmers or skier's. Also, workers sometimes wear equipment that allows them to more easily perform their job, such as a painter that puts on stilts in order to reach a ceiling or a coal-miner that wears a helmet with a light.

Currently, there exists apparel that is designed to have low friction surfaces, such as is described by U.S. Pat. No. 5,829,057 to Gunn. These garments are intended to either protect the skin or reduce, to a limited extent, normal frictional coefficients either between the wearer's body and the garment or between the garment and exterior surfaces, objects or fluids. These low friction garments are generally intended to prevent injuries that might be caused by sudden or abrupt stops when an individual's body is made to slide on a hard surface at high speeds. Also, these low friction garments are additionally intended to minimize drag coefficients through fluids such as air or water, in order to maximize athletic performance.

Additionally, it is known that protective yet functional equipment, such as rolling kneepads are available that provide protection and mobility to the wearer while still on his or her knees. U.S. Pat. No. 5,870,774 to Legenstein and U.S. Pat. No. 2,484,494 to Ferguson disclose just such rolling kneepads. This type of equipment is generally intended solely for workers and is limited to providing rolling mobility to a user on his or her knees.

The prior art does not disclose apparel or equipment that provides rolling surfaces over a substantial portion of a wearer's body and particularly on a user's upper body. Further, the prior art does not disclose a roller suit that includes additional apparel providing protection and frictional surfaces for directing, producing, retarding and stopping motion

SUMMARY OF THE INVENTION

In accordance with the invention there is presented a body suit that contains a plurality of rollers wherein a wearer's body can roll along a surface. More particularly, the roller suit can contain a distribution of rollers such that a wearer lying on a surface would be supported substantially by those rollers. The invention also relates to apparel and equipment worn for safety and control while using the roller suit. The invention further relates to methods for producing a roller suit.

It is a principle object of this invention to provide equipment and apparel which will facilitate a user's ability to roll along the ground or any surface desired. A further object of the invention is to provide a method for producing a body suit that contains a plurality of rollers that are selectively distributed over a body suit in order to support a user's weight and provide efficient rolling capability. It is another object of this invention to provide a method of producing a roller suit using a combination of soft cushioning materials and more rigid structures to support rollers. It is yet another object of the invention to provide equipment and apparel which contains a plurality of rollers and other surfaces for not only rolling on a surface, but controlling the speed and direction of travel along that surface.

One of the key elements to the invention relates to providing an efficient means for a wearer to roll along surfaces, that is incorporated into that wearer's apparel. Whether for entertainment or to accomplish tasks more easily the invention has numerous applications.

Another element of the instant invention is the location of rollers, which are strategically placed on the suit in order to support evenly a wearer's body while rolling. The rollers should be positioned in order to allow the wearer to make various body movements, while rolling, that do not unintentionally retard rolling.

In accordance with another aspect of the present invention, sufficient padding and protective gear can be provided in order to ensure the safety and comfort of a wearer. Equipment, such as a helmet, gloves, shoes and other gear can be used as part of the instant invention. Special gloves and shoes or shoe covers should be provided for steering, propulsion, positioning and breaking. Also, specific areas of the suit are provided with rigid plates designed to distribute impact loads felt by the users. Further, it is anticipated that padding would be provided in the suit in order to enhance the comfort to the wearer. Further still, the instant invention can include portions of the roller suit that provide ventilation or cooling.

In accordance with another aspect of the present invention, the roller suit should be adjustable in order to accommodate wearers of different sizes, proportions and shapes. The adjustments would allow a wearer to make the suit tighter or looser in various parts of the body as they desire.

In accordance with another aspect of the present invention, additional roller bearings can be added to the suit to provide additional roller support. Also, it is anticipated that the instant invention can be constructed with fewer rollers as desired. The use of fewer rollers could reduce the overall cost of constructing the suit as well as making the suit lighter and thus more comfortable. Further, it is anticipated that certain applications for the suit might not require rollers in particular areas, such as either the entire front or back.

BRIEF DESCRIPTION OF THE DRAWINGS

Those and other objects and advantages of the present invention will become more apparent by referring to the following detailed description and accompanying drawings in which.

DETAILED DESCRIPTION

As indicated above, the present invention is a body suit, which includes a plurality of rollers and some frictional and protective surfaces which will allow the user to roll along a surface. In an effort to provide a safe, comfortable and effective means for a user to actively roll in various positions the instant invention anticipates numerous configurations of rollers and pads.

Figure 1:
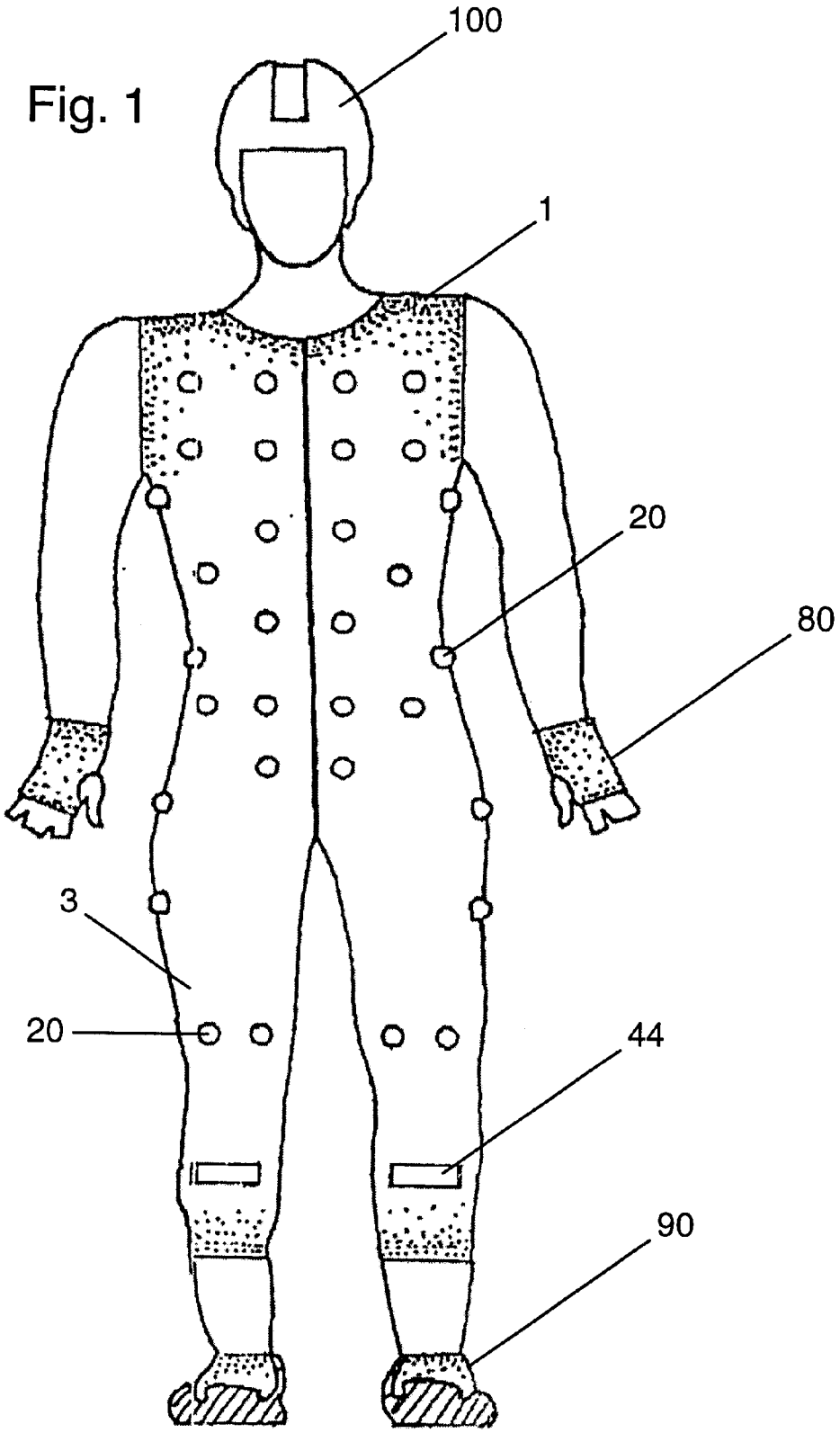
FIG. 1 is a front view of a roller suit in accordance with the instant invention.
Figure 2:
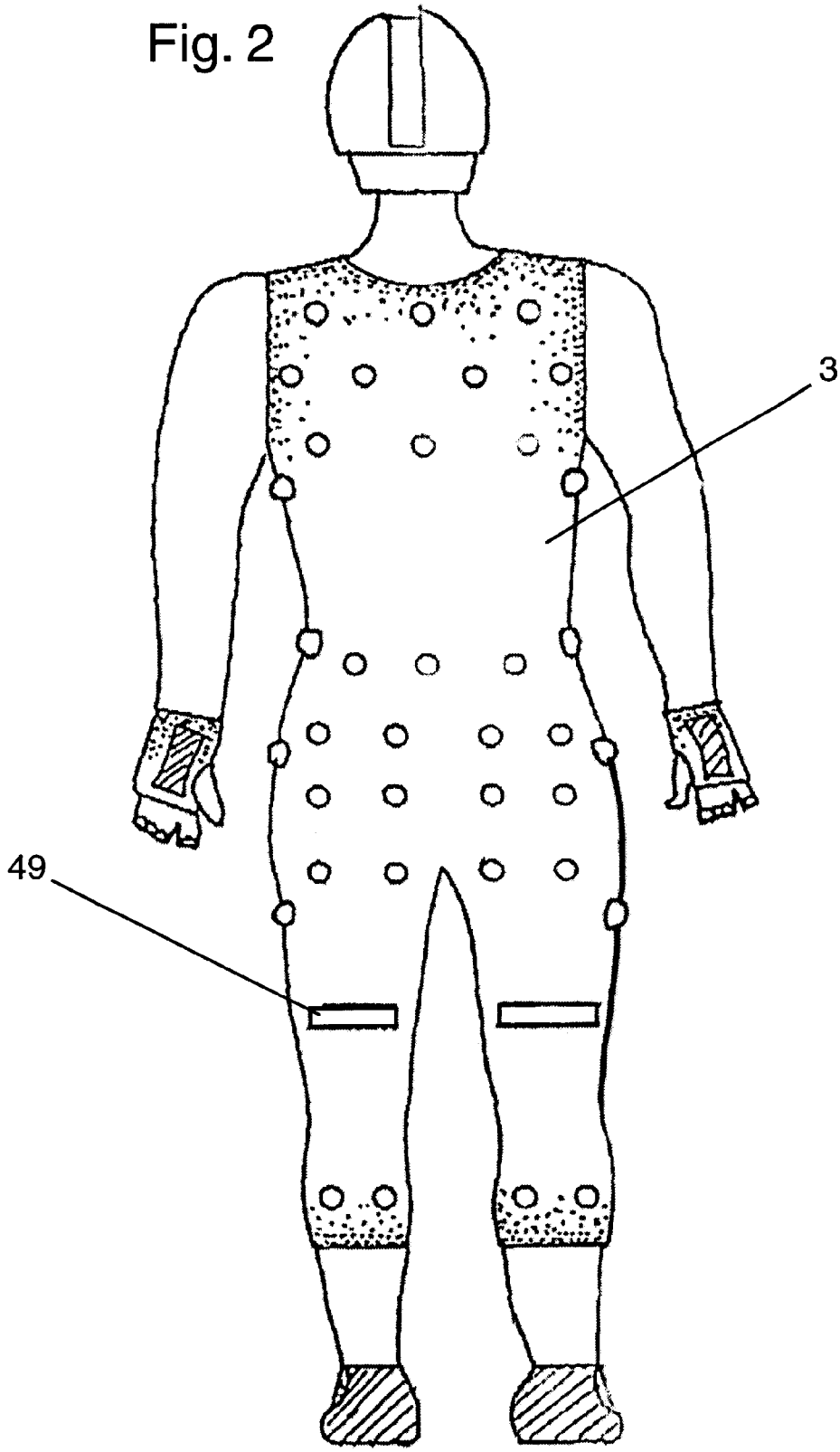
FIG. 2 is a rear view of a roller suit in accordance with the instant invention.
Figure 3:
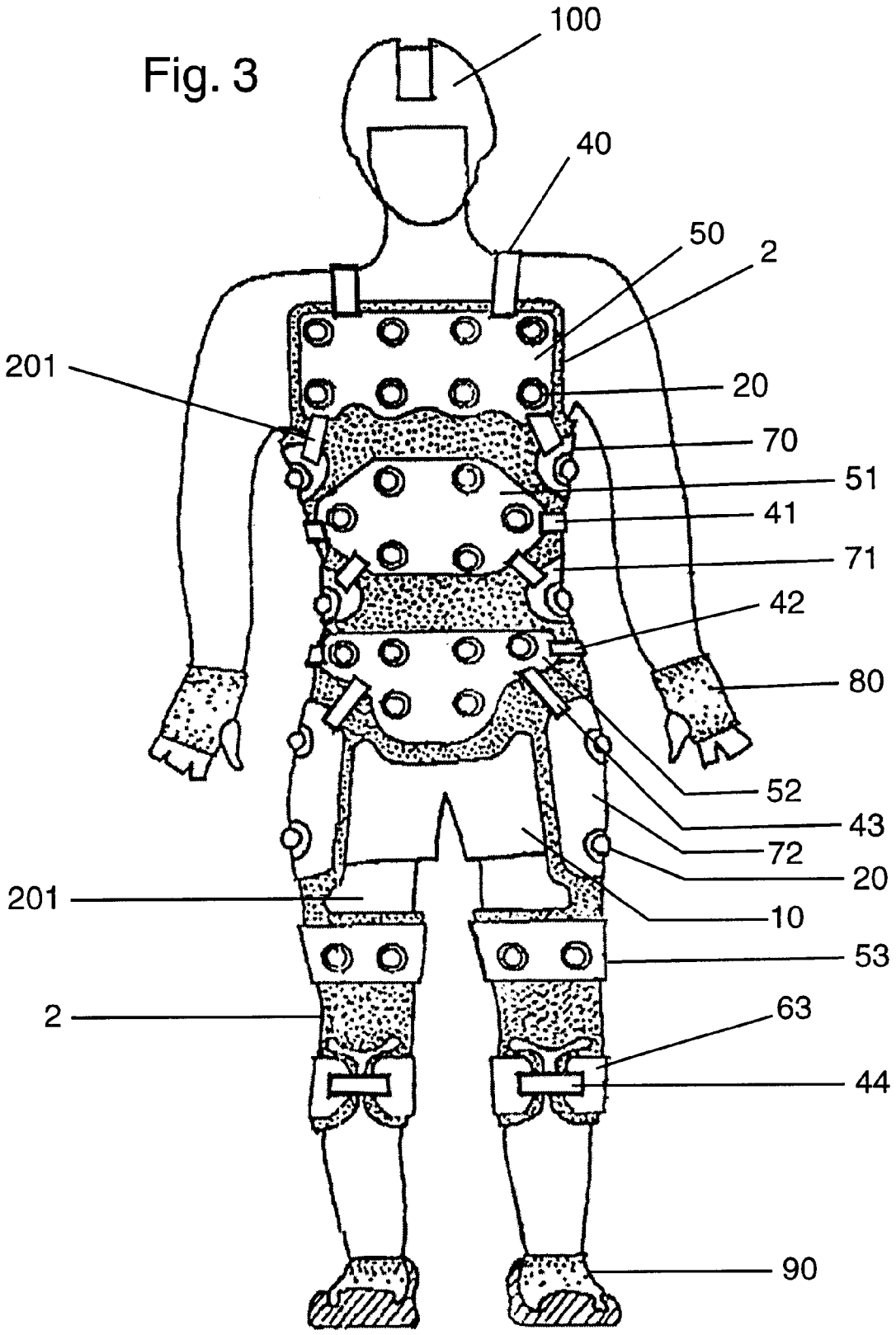
FIG. 3 is a front view of the roller suit of the instant invention, without the outer shell.
Figure 4:
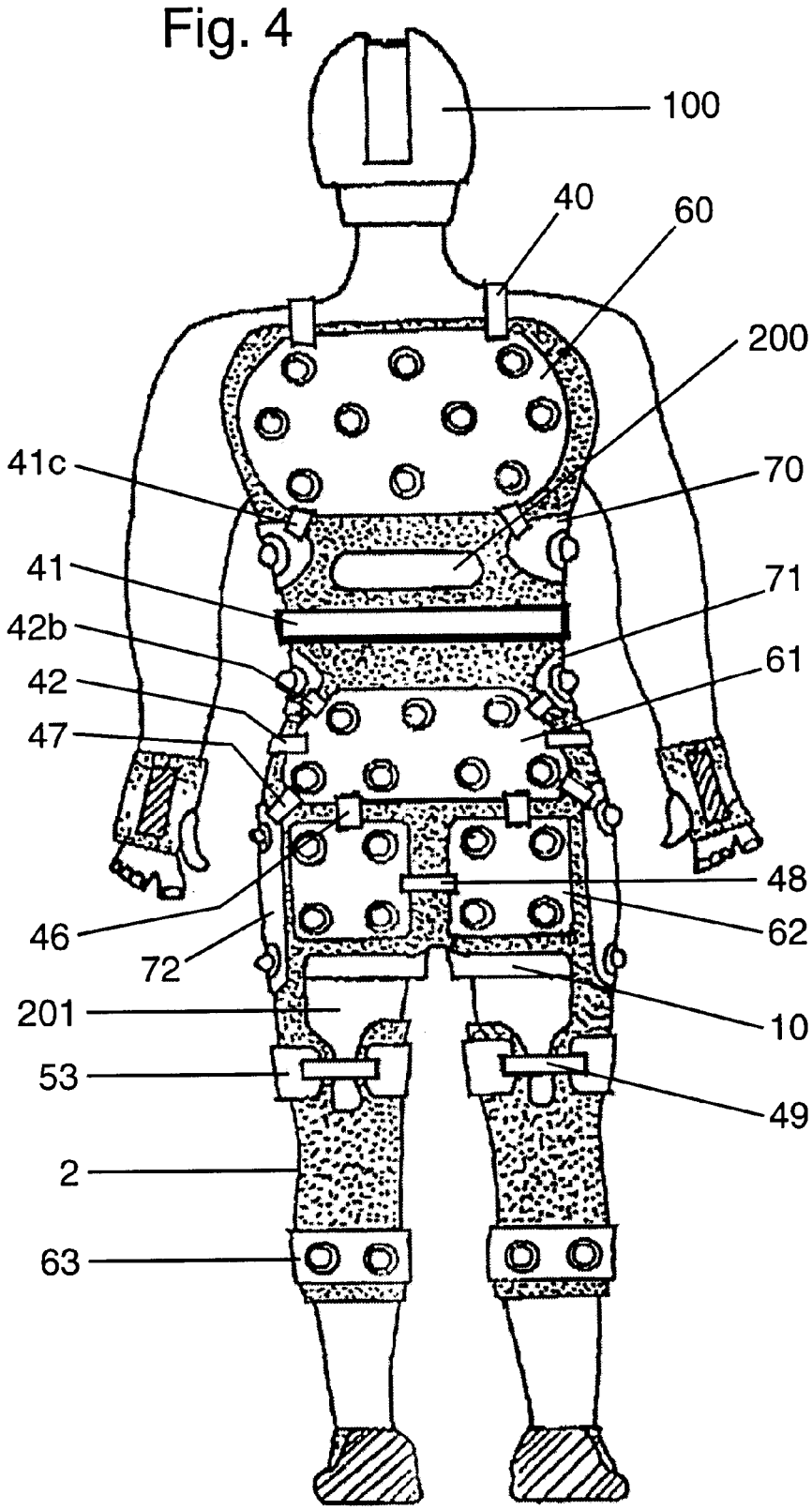
FIG. 4 is a rear view of the roller suit of the instant invention, without the outer shell.
Figure 7:
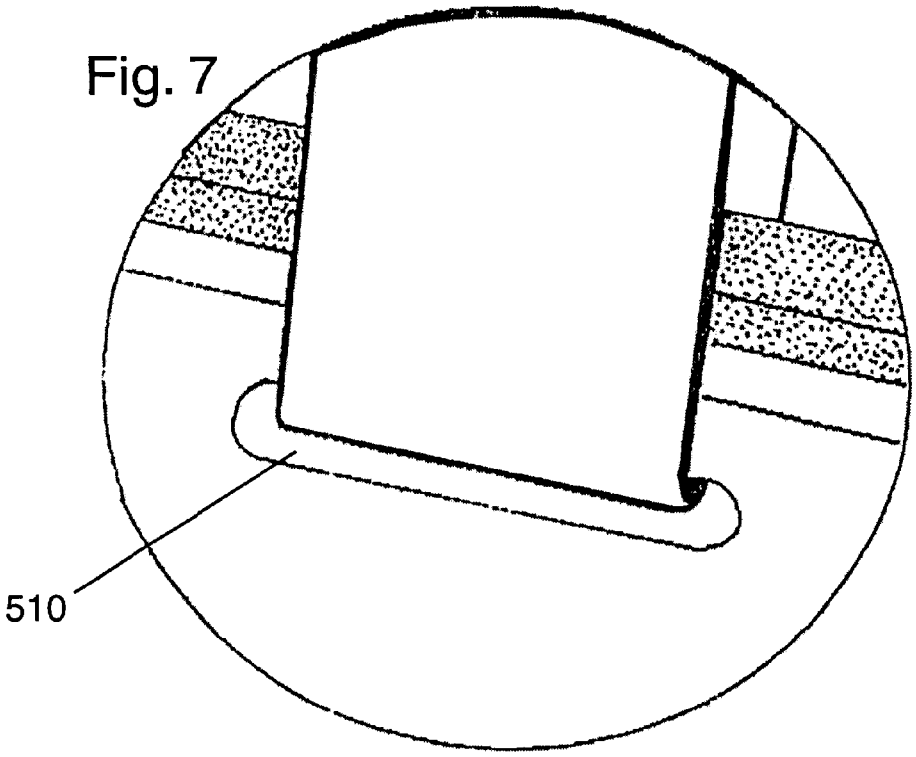
FIG. 7 is a relief view of a strap assembly, without an outer shell, as it loops through the foam padding and a rigid support plate.
Figure 8:
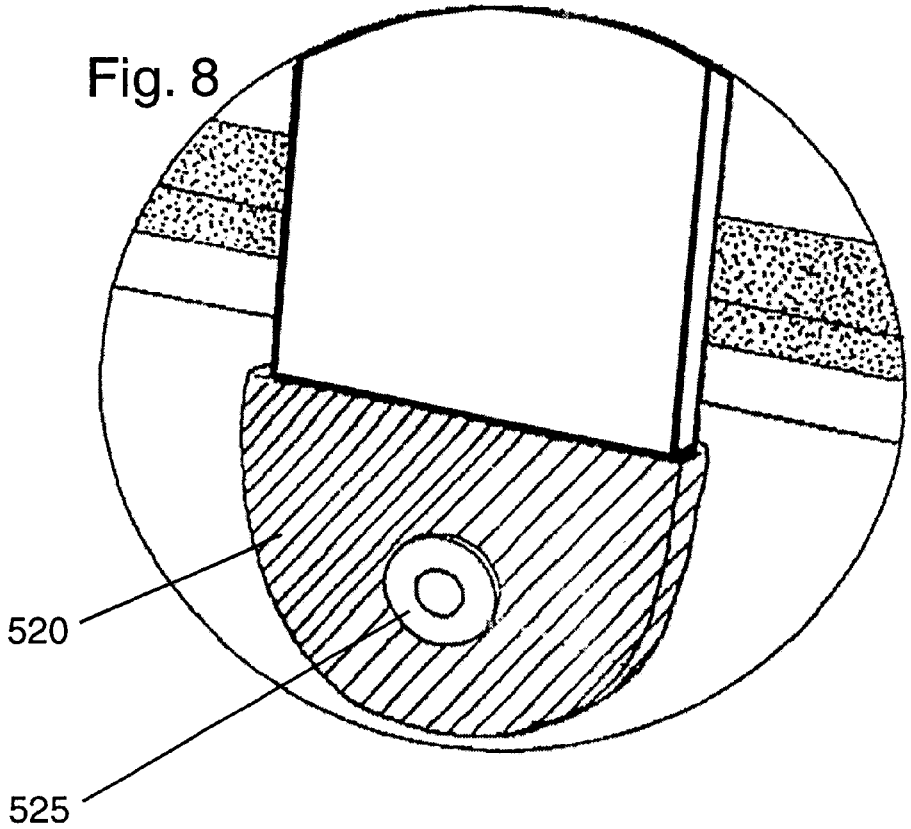
FIG. 8 is a relief view of an alternate embodiment of a strap assembly, without an outer shell, as it attaches to a rigid support plate using a rivet assembly.
Figure 9:
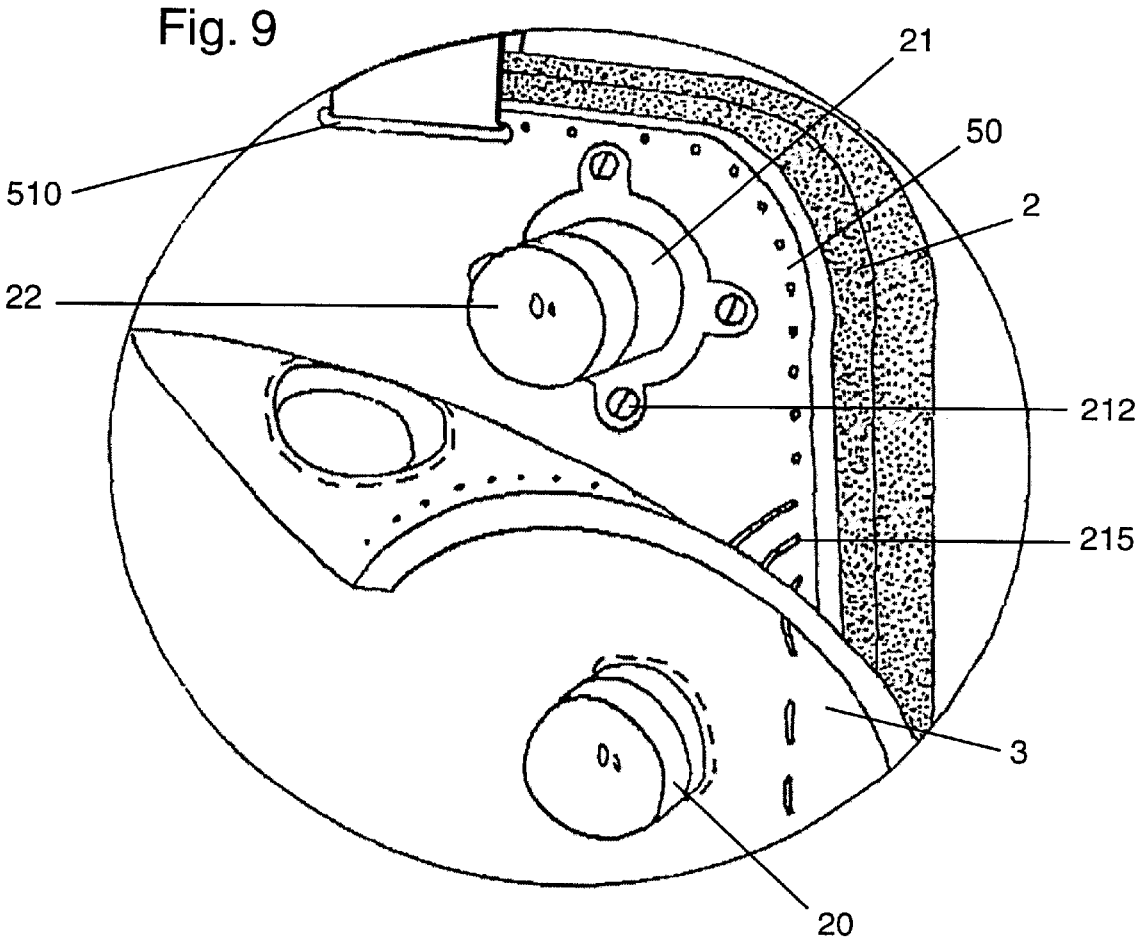
FIG. 9 is a partially disassembled detail view of the area surrounding the roller assembly used in the instant invention.

FIGS. 1 and 2 show the front and back view of a roller suit according to the instant invention and particularly the outermost layer of the suit. Similarly, FIGS. 3 and 4 show the front and back view of a roller suit with the outer shell removed and thus show the inner layers of the suit. The roller suit 1 is comprised of several layers. As seen in FIGS. 3 and 4, the innermost layer 2, intended to be in contact with a wearer's skin or undergarments 10, consists of foam padding. This foam padding innermost layer provides a cushion means that adds to the wearer's comfort and distributes or dampens impact loads on the wearer's body. As seen in FIGS. 1 and 2, the outermost layer or exterior shell 3, is a flexible and durable material that covers most of the wearer's body. This outer layer or covering means can vary in terms of thickness, color and style of material used in order to accommodate user preferences. Many aesthetic considerations can go into the outer layer. Additional inner layers include rigid support plates 50–53, 60–63, 70–72 which are used to support the roller bearing assembly and distribute impact loads over a broad area of a wearer's body. These rigid support means can be made of numerous materials that are capable of withstanding localized impact loads several times the weight of a user. These plates are distributed to accommodate roller bearing assembly 20 locations. In particular, in the front portion of the suit, plate 50 supports the chest area, 51 supports the torso area, 52 supports the mid-section and plates 53 support the wearer's leg, although located in the thigh region. In the rear portion of the suit plate 60 supports the upper back, 61 supports the lower back, plates 62 support the buttock area and plates 63 support wearer's legs although located in the calf region. On each side of the user's body plates 70, 71, and 72 support the latissimus, hip and upper thigh regions respectively. The support plates can be sewn into the fabric of the outer shell 3. Also, the support plates can be interconnected through a series of support straps 40–49 in order to minimize the strain of shifting plates on the outer shell 3. These straps provide positioning means in that they connect the plates and keep them snug and in position on the wearer's body by passing through holes 510 in the support plates as can be seen in FIGS. 7 and 9. Alternatively, as seen in FIG. 8, a rigid end fitting 520 along with a rivot 525 can be used to fix the straps to the support plates. In the preferred embodiment, it is anticipated that some of these straps will be a fixed length while others will be adjustable. In particular, providing straps 43, and 46–48 as fixed length straps could allow the suit to accommodate various sized users while reducing the number of adjustable straps necessary for the suit to still be adaptable to most users. Various adjustment means are anticipated including buckles and Velcro fastening. Velcro would be particularly useful in locations, such as for straps 44 and 49, where less bulk would be more comfortable. Although all or no straps could be adjustable the preferred embodiment tries to minimize the adjustable straps for simplicity and cost reduction.

Additionally, the layers of the roller suit 1 are designed to contain voids or ventilation areas 200 and 201. These ventilation areas are created by the absence of the foam or other material of which the inner layer is made.

Figure 5A:
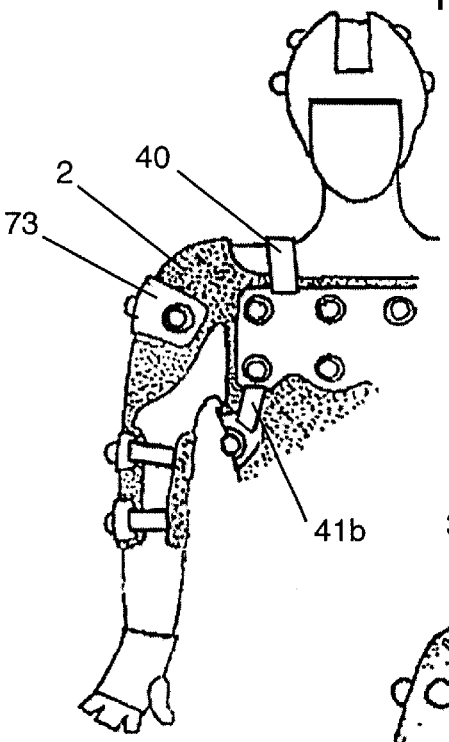
FIGS. 5A–C demonstrate an alternate embodiment of the instant invention including shoulder, elbow and helmet rollers.
Figure 5B:
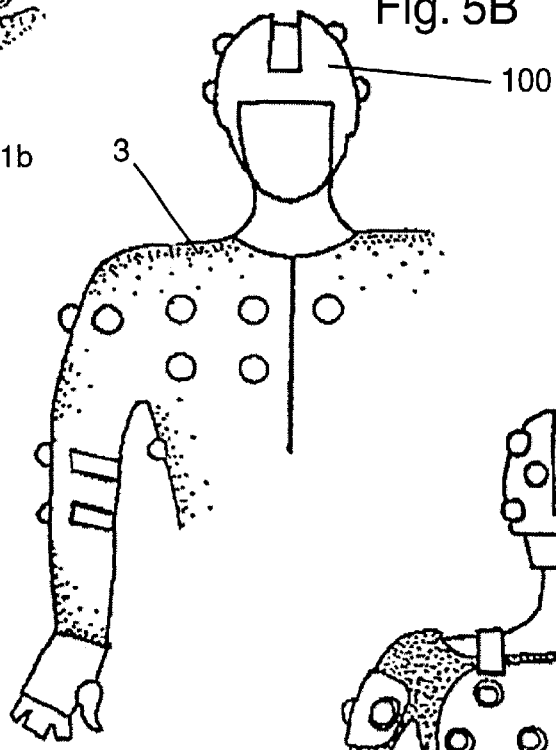
Figure 5C:
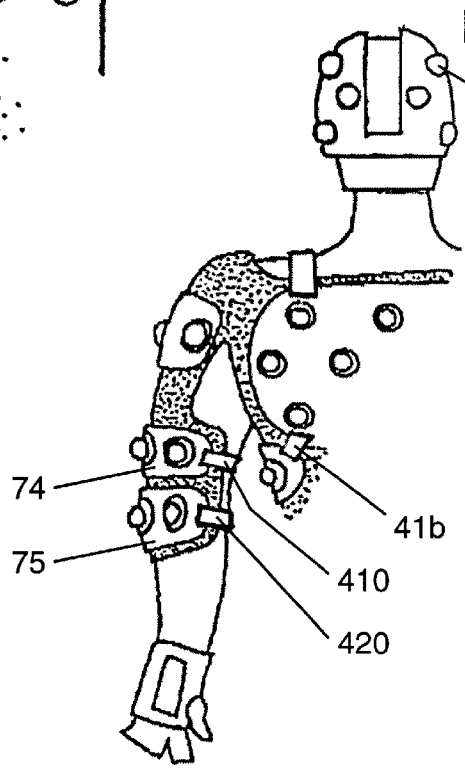
Figure 6A:
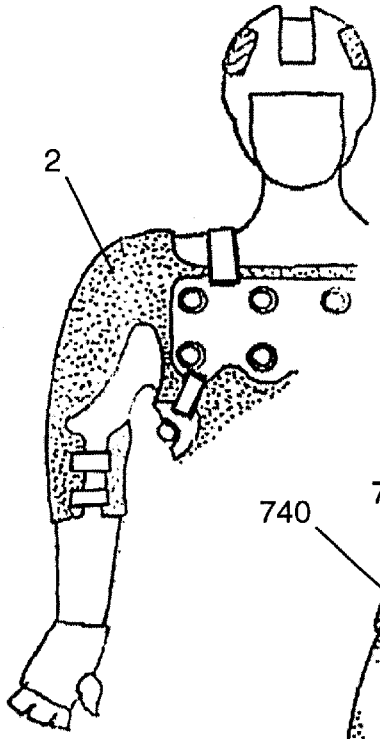
FIGS. 6A–C demonstrate an alternate embodiment of the instant invention including shoulder, elbow and helmet braking pads.
Figure 6B:
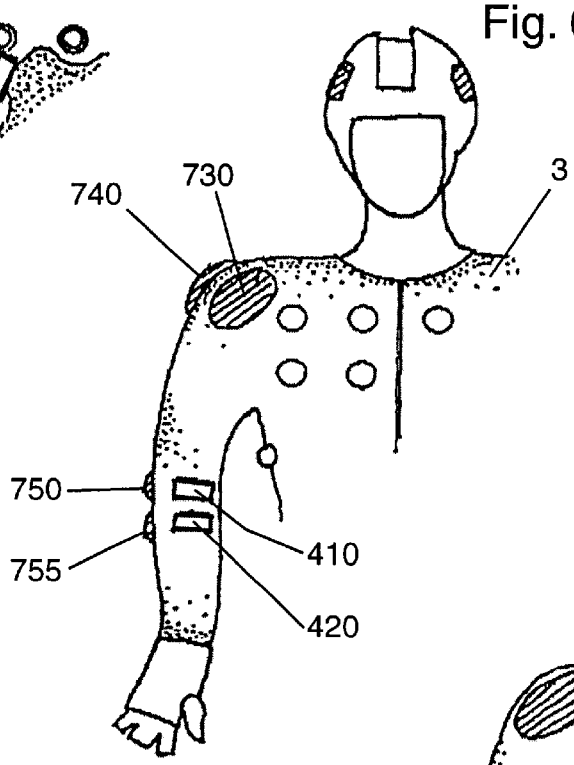
Figure 6C:
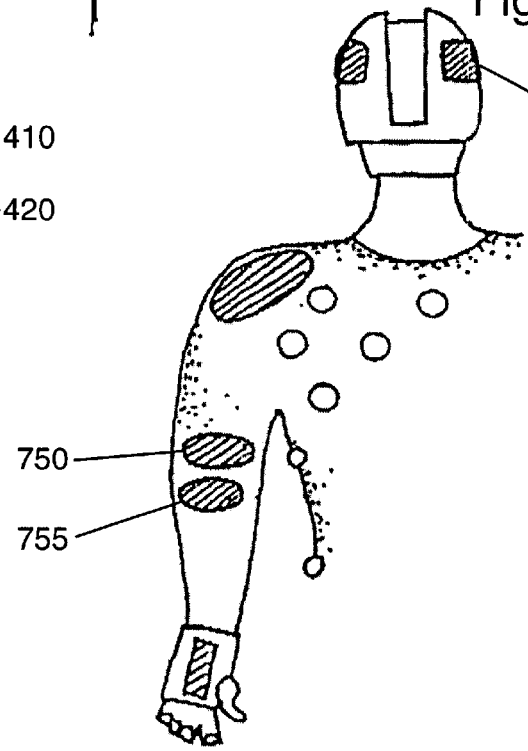

As seen in FIGS. 5A–C alternate embodiments of the instant invention are anticipated that use shoulder 73, elbow 74, 75 and helmet 101 roller assemblies and plates with corresponding additional straps 410, 420. Further as seen in FIGS. 6A–C, these same areas could be provided with braking pads 730, 740, 750 and 755 as additional means for the individual to control his or her movements. These braking pads 730, 740, 750 and 755 provide frictional engagement means for controlling movements of the suit. Such pads can impart, retard or merely control movement and rolling engagement of the suit. Combinations of these two embodiments using additional roller assemblies and braking pads are anticipated. In fact, virtually every location that uses a roller could potentially be designed to alternatively include a braking pad and visa-versa.

Figure 10:
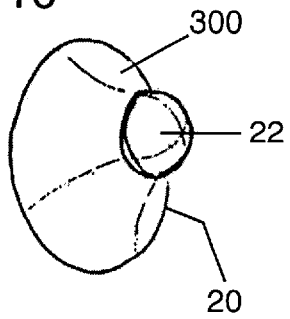
FIG. 10 is a perspective view of a roller bearing in an alternatively shaped cover unit.
Figure 11:
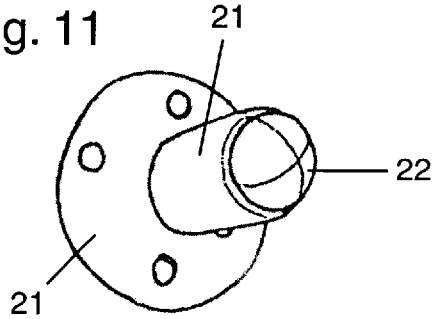
FIG. 11 is a perspective view of a roller bearing in a support socket without its cover unit.
Figure 12:
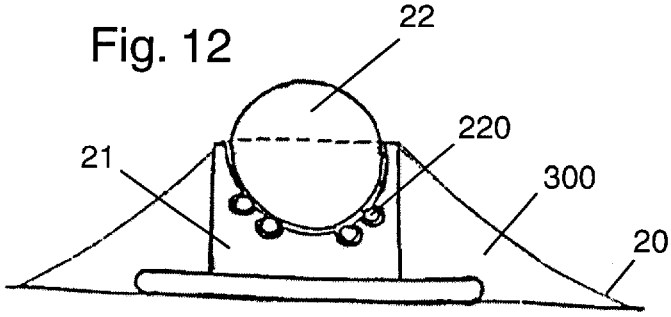
FIG. 12 is a cross-sectional view of a roller bearing and its support structure, including a conical cover unit.
Figure 13:
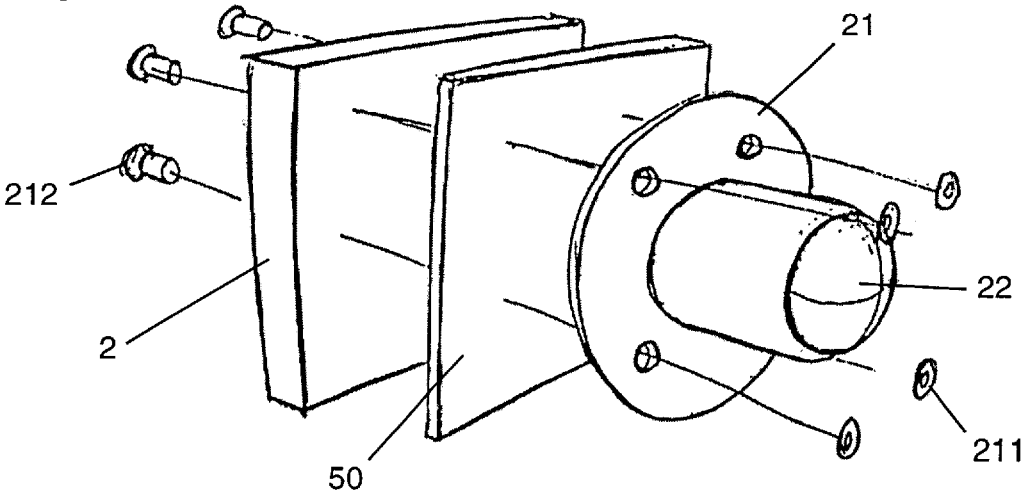
FIG. 13 is an exploded view of a roller bearing assembly.

As seen in FIG. 9, the roller bearing assemblies 20 provide rolling means for the suit and are fixed to a support plate 50 but protrude through the outer shell 3. FIG. 10 demonstrates a conical transition shell 300, which protects the bearing socket 21 (seen in FIG. 11) while leaving the ball bearing 22 exposed. This embodiment also provides a less industrial appearance to the whole roller bearing assembly 20. FIG. 12 illustrates one possible bearing socket 21 design that includes sub-bearings 220 to further reduce frictional coefficients. The support plate 50 is fixed to the foam padding 2 by either adhesives, stitching 215 or fasteners 211, 212 as seen in FIGS. 9 and 13. Such fasteners can be a nut and bolt assembly, rivets or other known fasteners. Also, the inner layer of foam padding 2 can be comprised of multiple layers. It is anticipated that as with composite materials, different types of foam can be used for the layers in order to take advantage of the properties of the selected materials and provide comfort, durability, flexibility and support.

Figure 14:
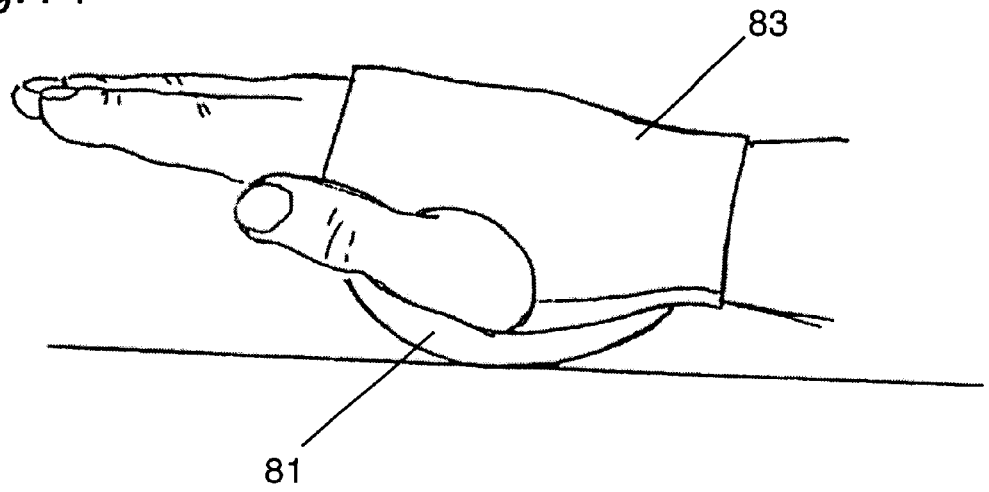
FIGS. 14 is a side view of a user applying a padded glove to a surface.
Figure 15:
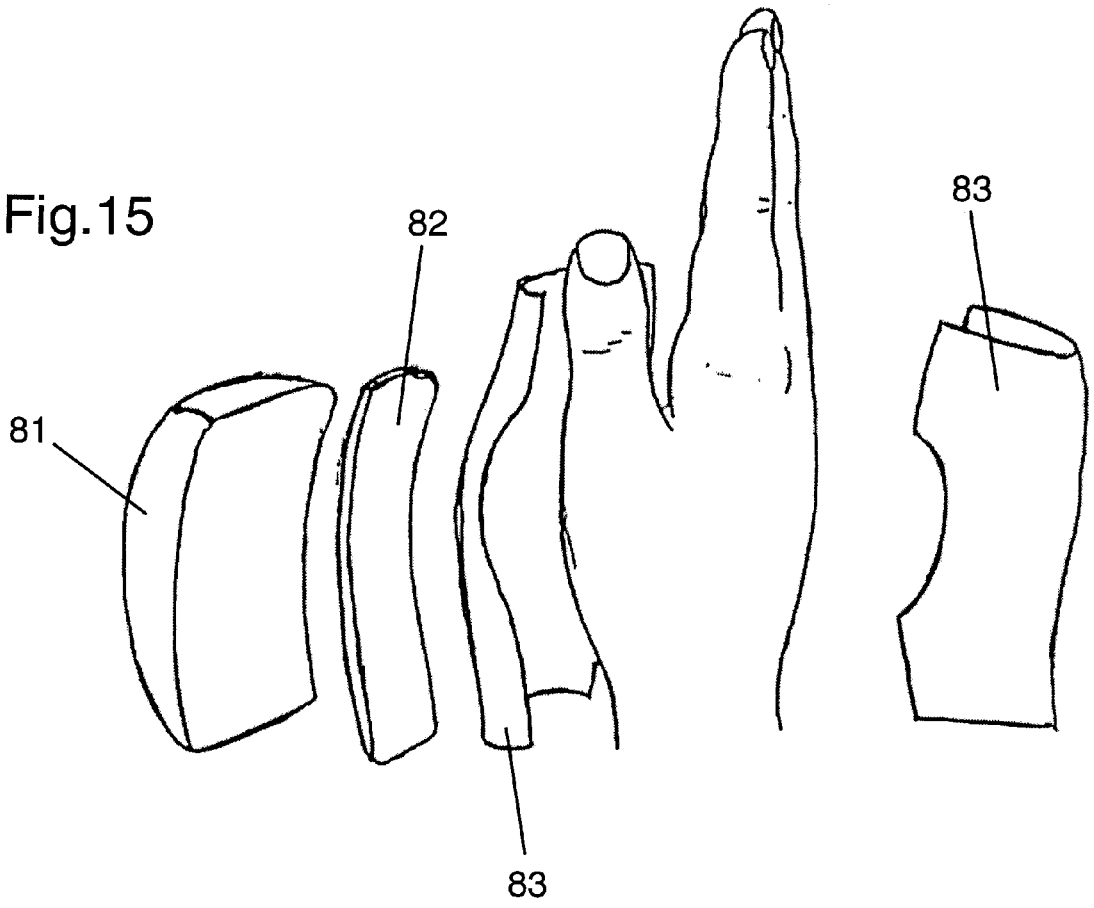
FIG. 15 is an exploded view of a padded glove assembly.
Figure 16:
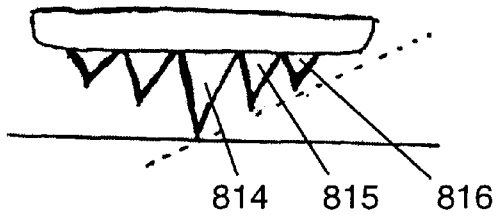
FIGS. 16, 17A,B & 18 A,B show side views of additional alternate embodiments of the glove pads.
Figure 17A:
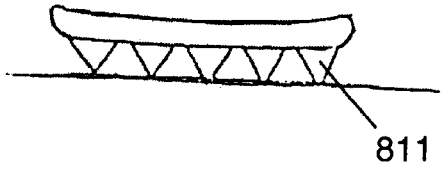
Figure 17B:
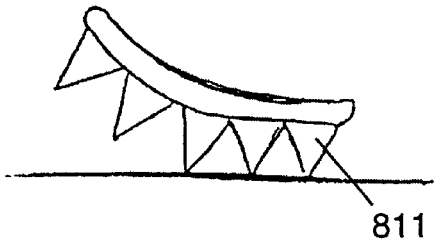
Figure 18A:
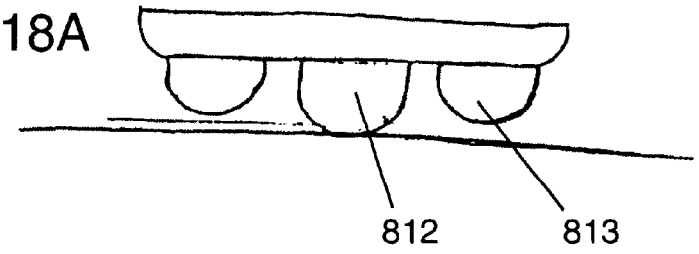
Figure 18B:
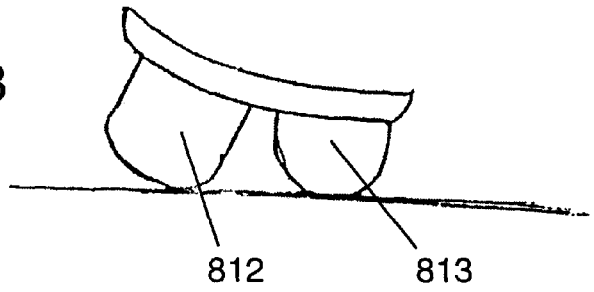
Figure 19A:
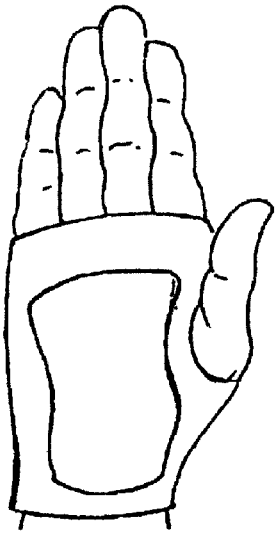
FIGS. 19A–M show alternate embodiments of the glove with varied pad configurations.
Figure 19B:
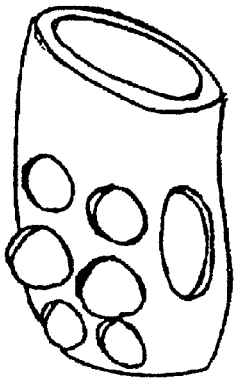
Figure 19C:
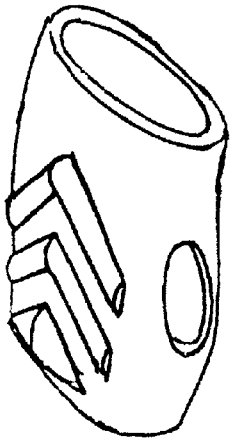
Figure 19D:
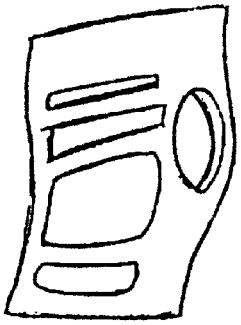
Figure 19E:
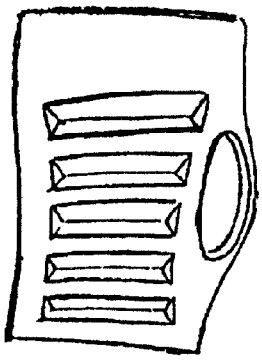
Figure 19F:
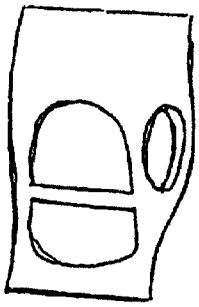
Figure 19G:
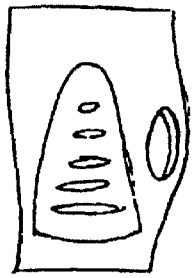
Figure 19H:
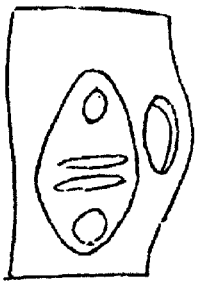
Figure 19I:
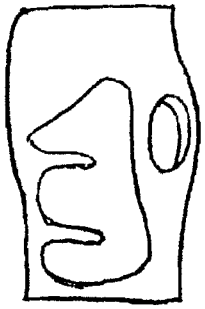
Figure 19J:
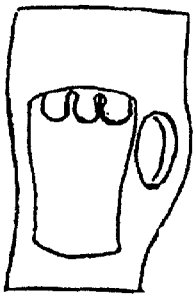
Figure 19K:
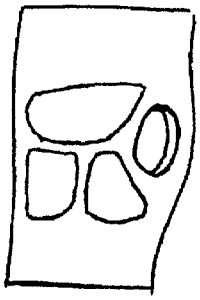
Figure 19L:
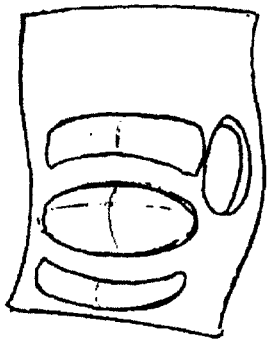
Figure 19M:
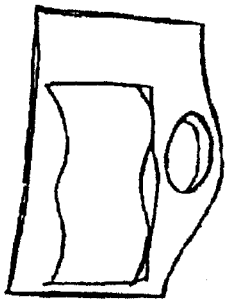
Figure 20A:
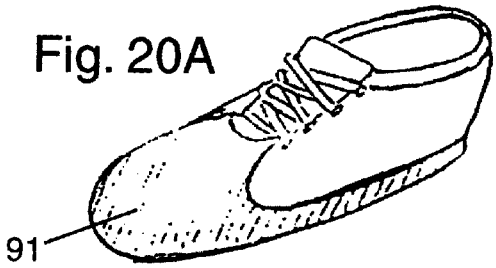
FIGS. 20A–I demonstrate various embodiments of padded footwear.
Figure 20B:
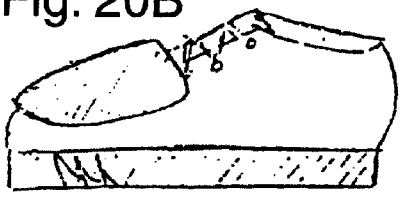
Figure 20C:
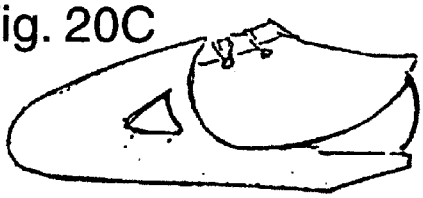
Figure 20D:
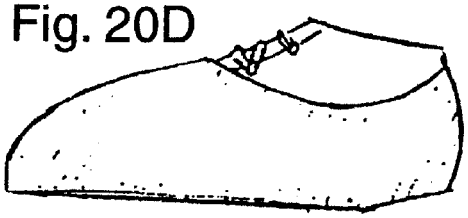
Figure 20E:
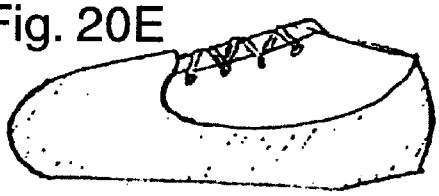
Figure 20F:
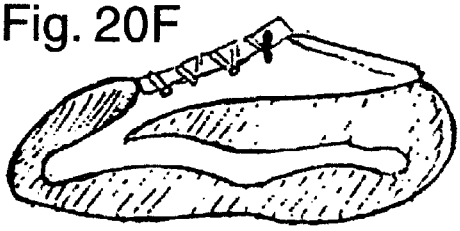
Figure 20G:
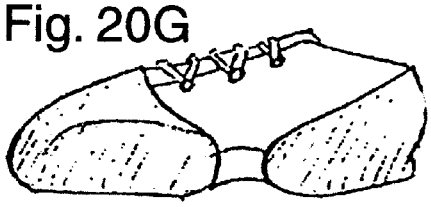
Figure 20H:
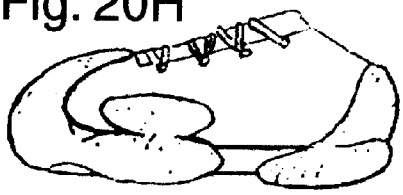
Figure 20I:
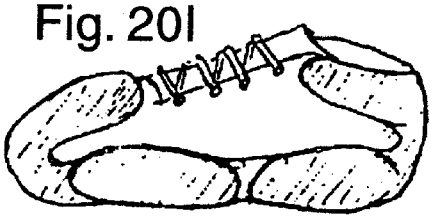
Figure 21A:
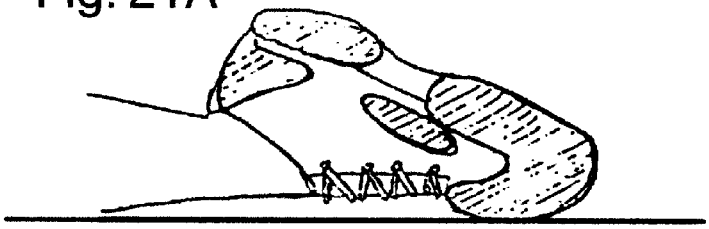
FIGS. 21A & 21B show views of a user applying different parts of padded footwear to a surface.
Figure 21B:
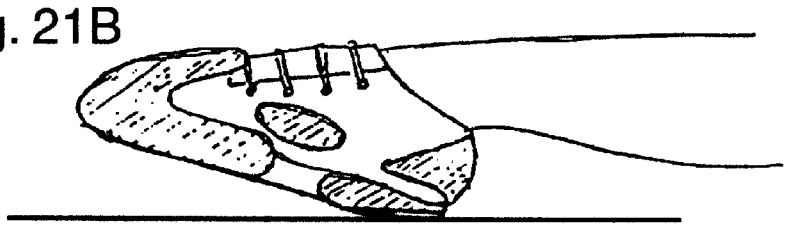

Additional accessories or equipment can be used as part of the instant invention, such as gloves 80, shoes or shoe pads 90 and a helmet 100. FIGS. 19A–M demonstrate some basic glove designs with varied pad shapes and configurations. The most basic glove, as seen in FIG. 14, includes a large rubber pad 81, a rigid wrist guard member 82, and a foam neoprene layer 83 in contact with the wearer's skin. FIGS. 16, 17A,B and 18 A,B demonstrate some of the advantages of alternate glove pad embodiments. Separate smaller pads 811 provide more flexibility in the glove as can be seen in FIGS. 17B and 18B. Additionally, smaller pads of different heights 812–816 as seen in FIGS. 16, 18A and 18B allow a user to apply differing degrees of friction to the underlying rolling surface.

Figure 22:
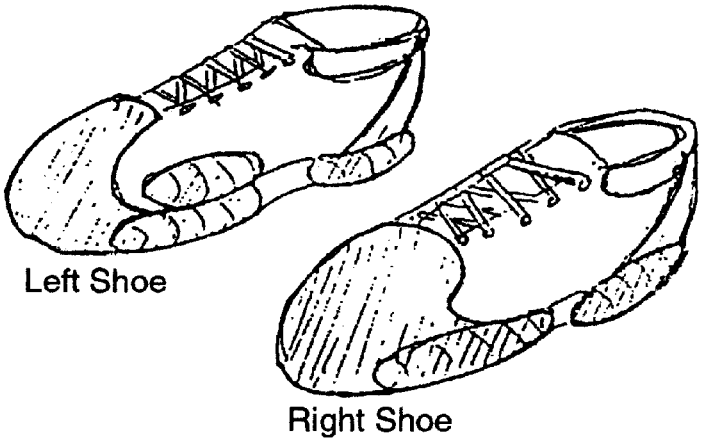
FIG. 22 is a perspective view of the left and right side of padded footwear in at least one embodiment.
Figure 23:
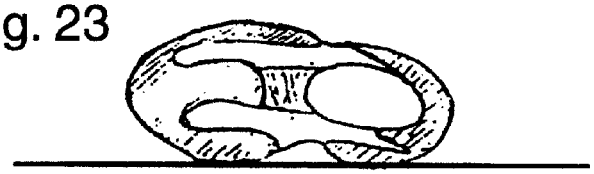
FIG. 23 shows a user simultaneously applying two padded portions of one shoe to a surface.
Figure 24A:
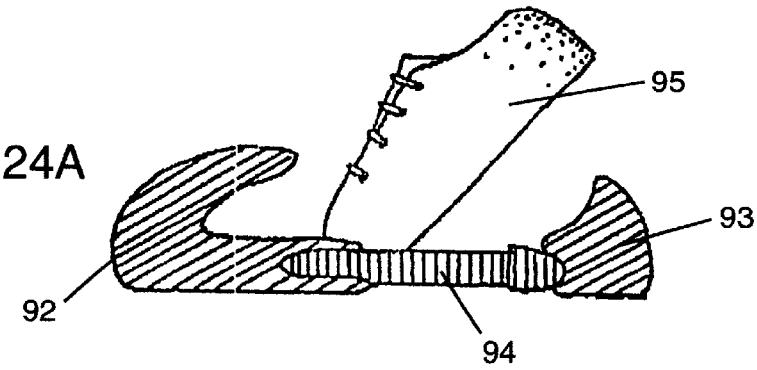
FIGS. 24A–C show side views of three different phases for one embodiment of footwear padding as it is being donned by a user over standard footwear.
Figure 24B:
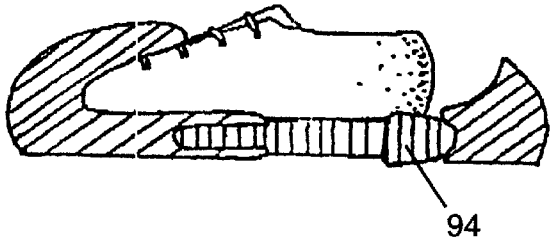
Figure 24C:
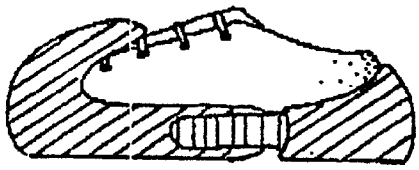
Figure 25A:
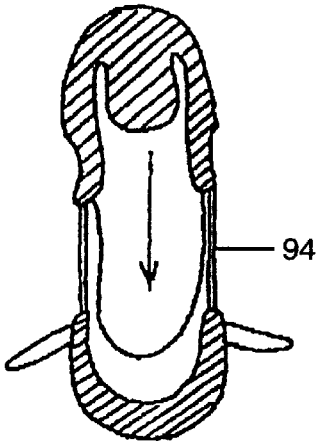
FIGS. 25A–C show top views of three different phases for one embodiment of footwear padding as it is being donned by a user over standard footwear.
Figure 25B:
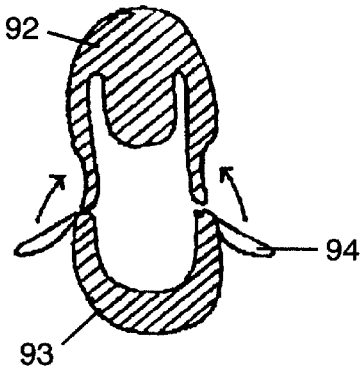
Figure 25C:
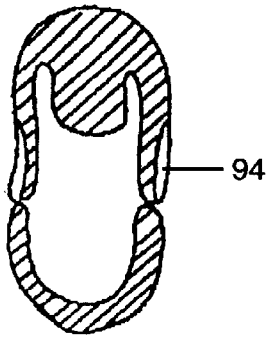

FIGS. 20–25 demonstrate various embodiments of padded shoes that could assist a user of the roller suit 1. Although a customized shoe or sneaker can be created in accordance with FIGS. 20A–I, 21A,B, 22 and 23, the padded surfaces 91 also could be added to standard shoes and sneakers. Like rubber galoshes, a padded protective outerwear may be applied to standard 2") footwear that provides similar benefits as the custom shoe at a drastically reduced cost. FIGS. 21A, 21B and 23 demonstrate how the padded surfaces can be used by a wearer. FIG. 22 demonstrates how the pads can be different on each side of the footwear for a right and left shoe or shoe cover. FIGS. 24A–C and 25A–B show a side view and a top view, respectively, of one embodiment of a shoe cover. In this embodiment of the protective shoecover, the front 92 and back 93 portions can be adjusted or secured onto standard footwear 95 by using the securing mechanisms 94. Although the securing mechanism can be something simple such as a strap and buckle configuration, it could also involve a more modem securing mechanism such as the buckles commonly used on ski boots. The buckle or securing mechanism should be designed to as to not protrude more than the pads provided on the front and back portions, so that they will not catch on surfaces or obstruct performance.

Figure 26:
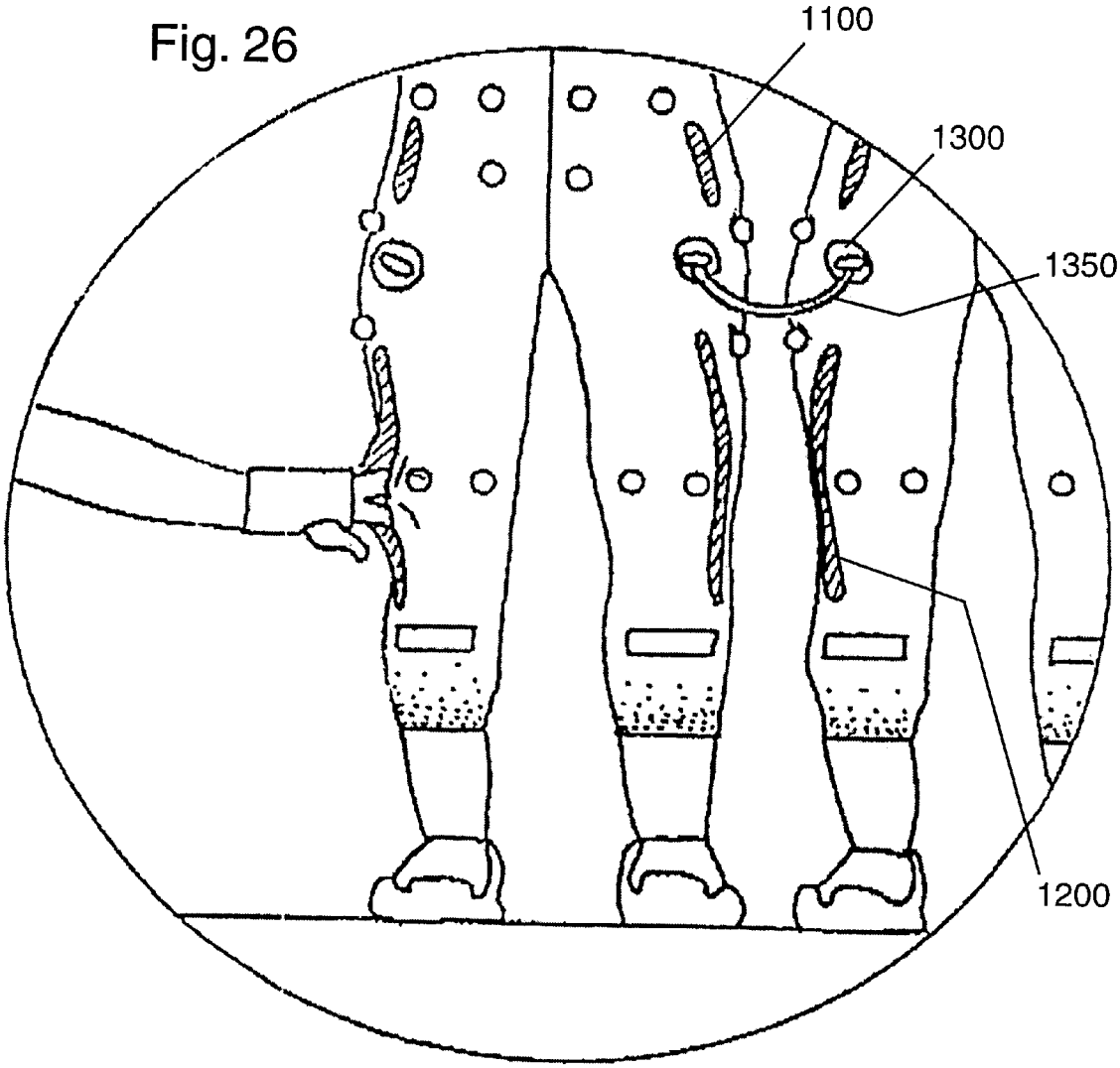
FIG. 26 shows various coupling means for multiple users of the instant invention to maintain, impart or retard movement in unison.
Figure 27:
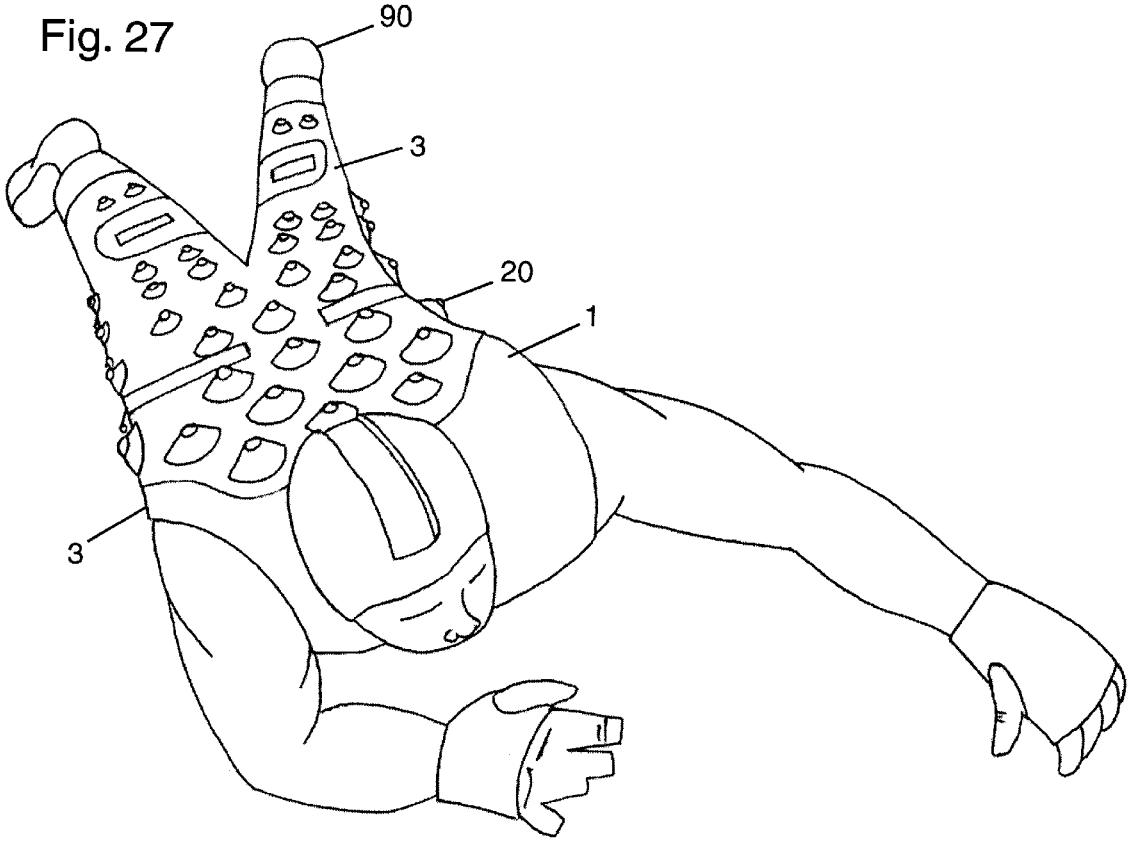
FIG. 27 is a perspective view of a roller suit worn by a user in the prone position.
Figure 28:
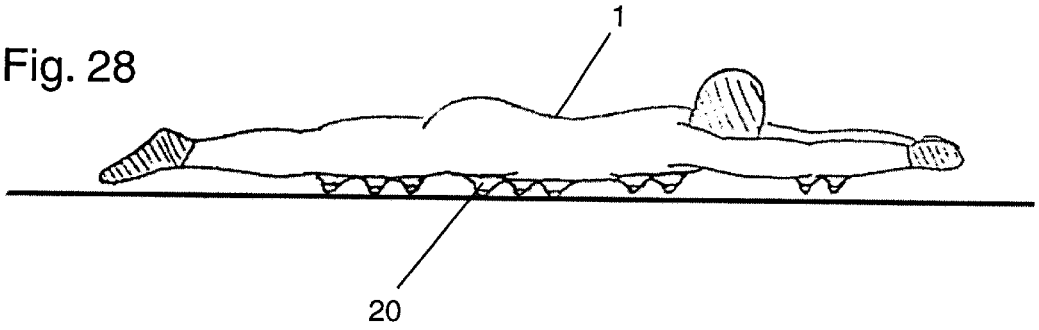
FIG. 28 is a side view of one embodiment of the instant invention worn by a user in the prone position.
Figure 29A:
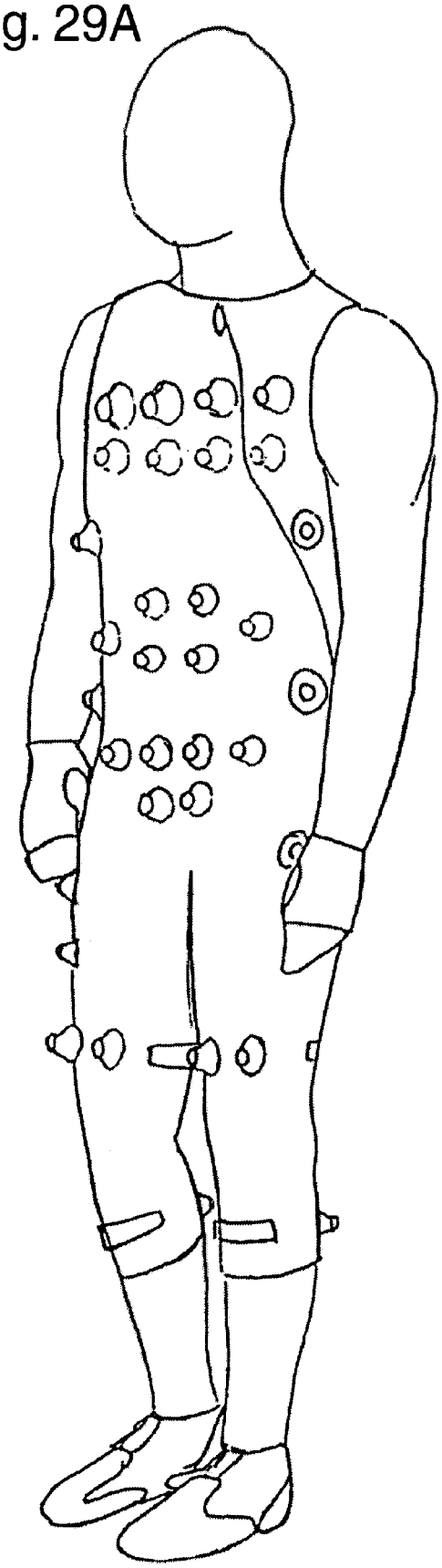
FIGS. 29A–F are alternative embodiments for roller placement and body suit layout.
Figure 29B:
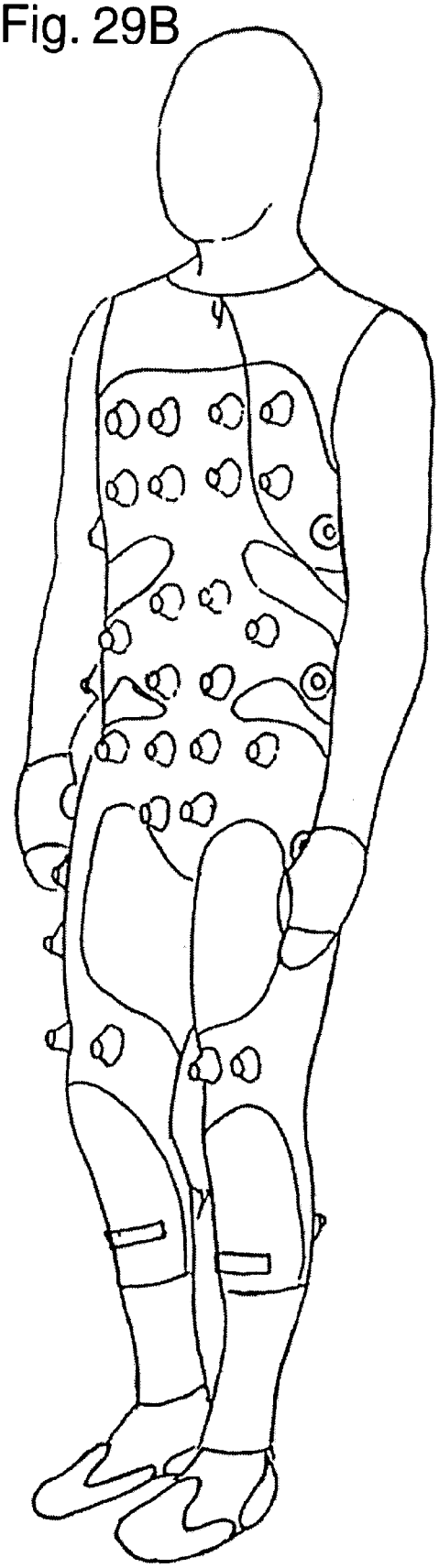
Figure 29C:
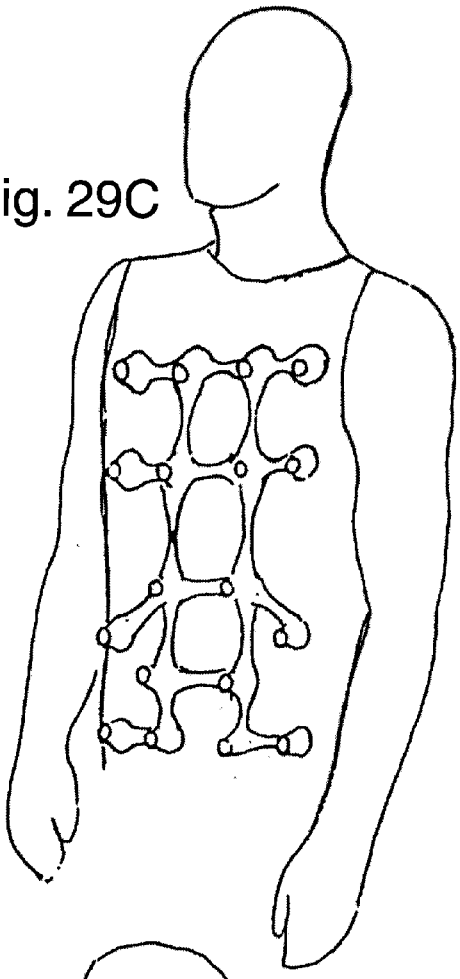
Figure 29D:
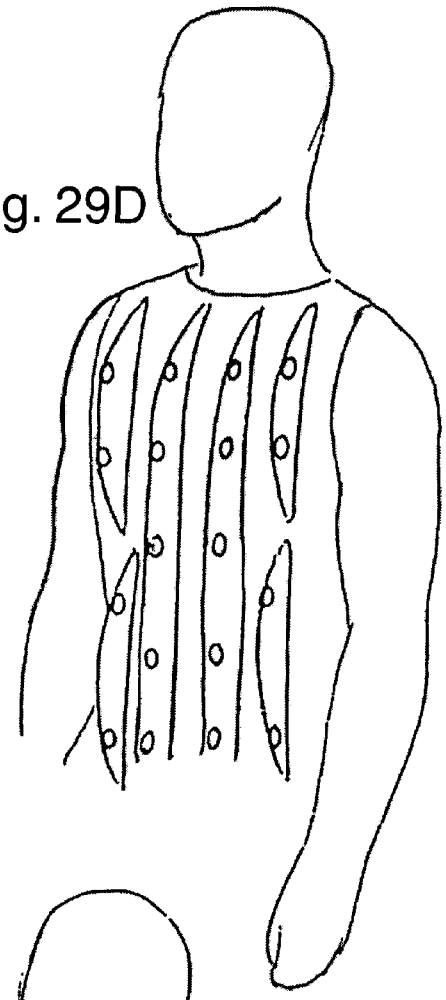
Figure 29E:
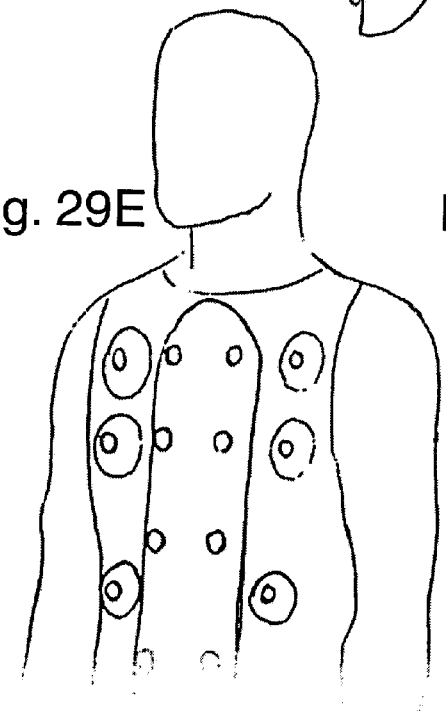
Figure 29F:
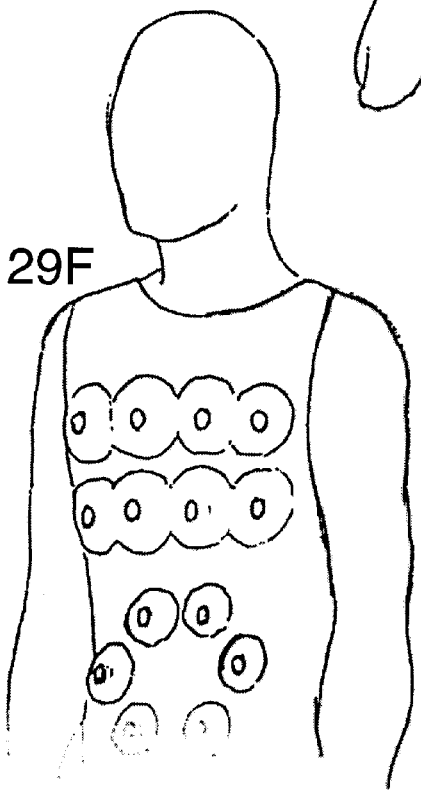

In accordance with another aspect of the current invention it is anticipated that multiple users might wear roller suits and use them together. In the same way that skydivers often couple or hang-on to one anther so too can users of the roller suit. Also, another individual not wearing such a suit might want to grab onto a roller suit user to either stop or start the roller suit user rolling. As seen in FIG. 26, coupling means such as the padded areas 1100, 1200 provide a surface that can be grabbed by another user. Numerous such surfaces should be provided so as to give users alternate locations on which to hang-on. Alternatively, coupling means could involve a plastic loop 1300 or other mechanism for securing a strap or tether 1350. Providing a quick-releasing type mechanism for such a strap or tether 1350 would provide safety, allow the users to maintain a hands-free connection and allow the users to separate when needed. It is further anticipated that the strap or tether could comprise an elastic band.

It is anticipated that numerous fabrics could be used for the interior foam padding 2 and the exterior shell 3, such as polyester, cotton, rubber or foam neoprene. Considerations in selecting a fabric would include cost, protection to the wearer, durability, flexibility, comfort, style and ease to work with in suit assembly.

It is further anticipated that the bearing assembly support plates 50–53, 60–63, 70–72 could be constructed using more or less material than is shown herein. Although the use of more material would distribute the impact loads to a broader area, this would also drive up manufacturing costs and could also further restrict user mobility. The use of less material could have the opposite effect. It is anticipated that through experimentation and use of the instantly disclosed roller suit and obvious variations thereof, the size, shape and location of the bearing assembly support plates could be adjusted for comfort, efficiency and particular applications of the roller suit and accessories. This same principal applies to the distribution and location of roller assemblies 20. Experimentation and use will likely indicate alterations in the roller assembly locations based on functional characteristics as well as aesthetic considerations. It is further anticipated the roller assemblies 20 could vary in size throughout the suit in order to similarly provide proper support and performance to a user.

Figure 30:
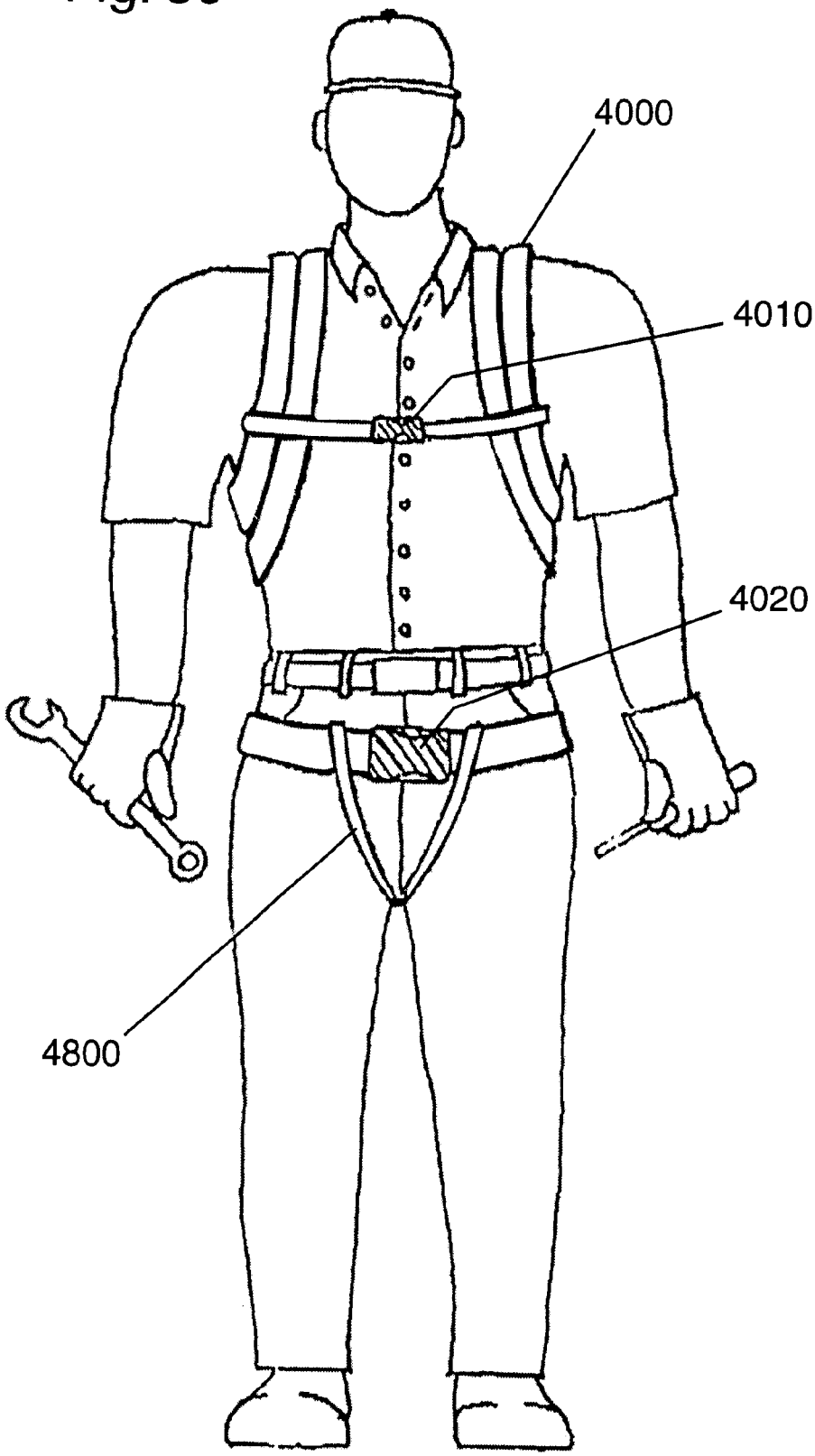
FIGS. 30 & 31 front and rear views, respectively, of an alternate embodiment of the instant invention.
Figure 31:
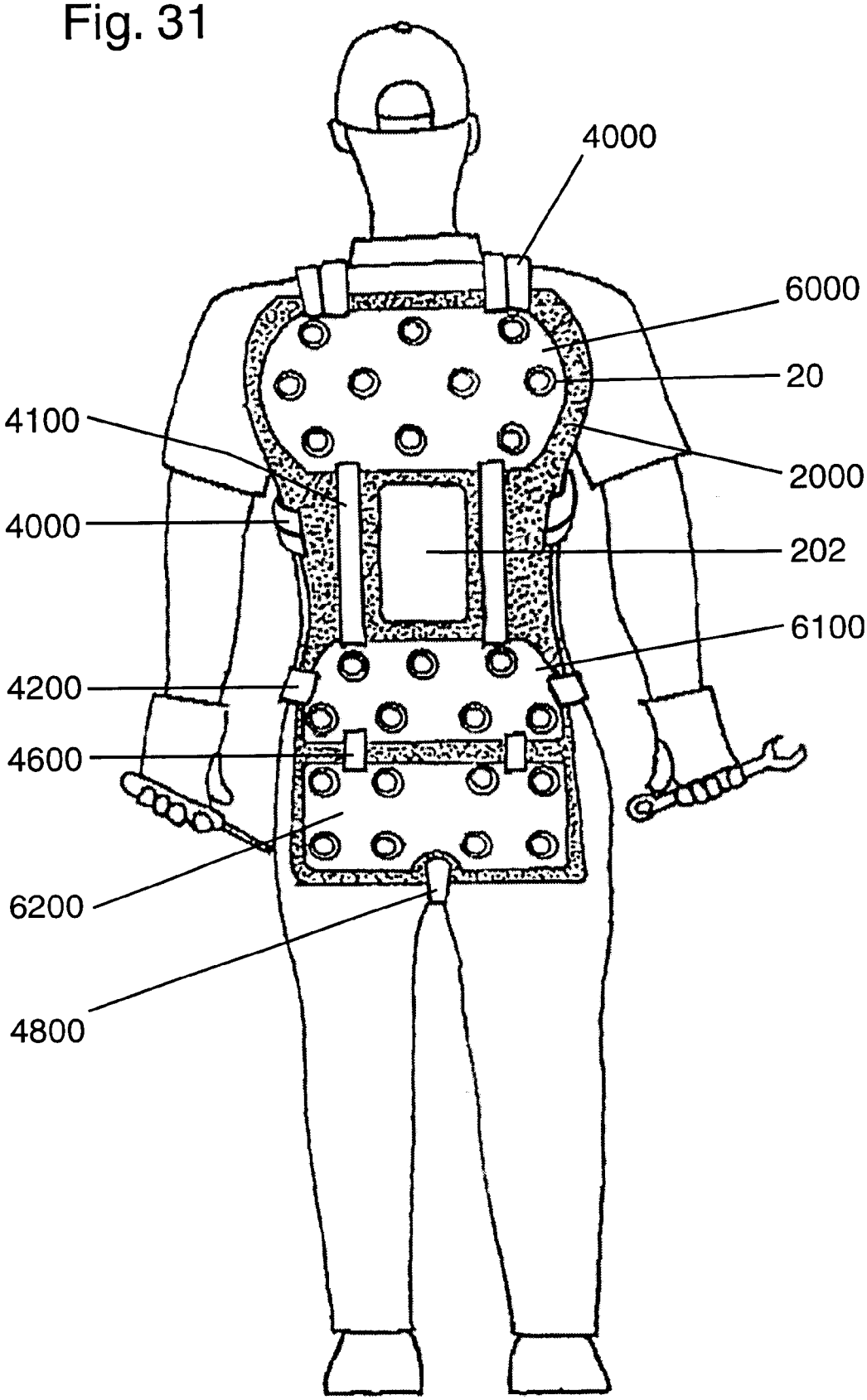

FIGS. 30 and 31 illustrate an alternative embodiment of the instant invention that is dedicated to providing the rolling surfaces only on one side of a user's body. The particular embodiment shown demonstrates rolling surfaces on the user's back. Such an embodiment could be particularly useful to a mechanic or any individual who needs to slide into a tight area on his or her back. This embodiment has many benefits over the traditional rolling dolly. For example, a worker using a dolly could have problems with it being not in the correct position on the worker's back. What is more, if the user repeatedly gets on and off the dolly it would have to be readjusted every time the use it. The roller suit could be easily donned and worn throughout the day, thus avoiding the problems of a dolly.

FIGS. 30 and 31 demonstrate alternative straps 4000, 4100, 4200, 4600 and 4800. The strap 4000 is intended to be worn like the straps commonly found on a backpack, with an additional stabilizing buckle 4010. The stabilizing buckle will prevent the shoulder strap 4000 from sliding off the user's shoulder. Similarly, belt strap 4200 is to be worn like a tool belt that includes a front buckle 4020 and crotch straps 4800 to maintain the suit in position on the user's body. The central back straps 4100 connect the upper back plate 6000 with the lumbar back plate 6100. The buttocks strap 4600, provides some flexibility and a connection between the lumbar support plate 6100 and buttocks plate 6200. As with the previous embodiments, the support plates can be fastened to a soft inner foam layer 2000 that comes in contact with a user's clothes, undergarments or skin. Also, a ventilation area 202 is anticipated for this version of the suit.

Although not shown in FIG. 31, an outer shell can be provided for the roller suit of this embodiment. Such an outer shell can be similar to the body suit of the earlier embodiments, but could also be limited to covering the areas where rollers are located, i.e., the user's back. Additionally, although not shown, rollers could be limited to the front of the suit, using a similar design to the first embodiment described above, but merely eliminating rollers from the back side of the suit. In such an embodiment, support straps 40, and 41 c would join in the user's upper back region and support strap 42 would be look more like support strap 41. Also, the left side support strap 42*b* would join with the right side support strap 47, and visa-versa for the right side support strap 42*b* and the left side support strap 47. Further, leg plates 63, support strap 44 and the associated rollers would not be necessary in such an embodiment.

Thus it is apparent that there has been provided in accordance with the invention that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What is claimed is:

1. An article of clothing worn on a body comprising:

a plurality of rolling means for providing rolling engagement between the article and a surface not affixed to said article, wherein at least one of said plurality of rolling means is located immediately adjacent to at least one portion of said body that is closer to the head of said body than the legs of said body;

at least one rigid support means affixed to said plurality of rolling means providing a base for said plurality of rolling means and located between each of said plurality of rolling means and said body;

at least one positioning means for maintaining said at least one rigid support means in substantially the same location on said body during rolling engagement with said surface; and at least one outer covering means for providing an outer layer of material to said article, wherein said at least one rigid support means is affixed to said at least one outer covering means and said at least one rigid support means is located between said at least one outer covering means and said body.

2. The article of claim 1, wherein said at least one rolling means comprises at least one bearing which provides rolling contact with said surface, and said at least one rolling means further comprising a socket which rotatably secures said at least one bearing, and an outer shell surrounding said socket and wherein said socket has a cylindrical outer shape and protrudes through said outer shell away from said body.

3. The article of claim 1, wherein said at least one rolling means comprises at least one bearing which provides rolling contact with said surface, and said at least one rolling means further comprising a socket which rotatably secures said at least one bearing, and an outer shell surrounding said socket and wherein said socket does not protrude away from said body beyond at least one outermost portion of said outer shell.

4. An article of clothing worn on a body comprising:

a plurality of rolling means for providing rolling engagement between the article and a surface not affixed to said article, wherein at least one of said plurality of rolling means is located immediately adjacent to at least one portion of said body that is closer to the head of said body than the legs of said body;

at least one rigid support means affixed to said plurality of rolling means providing a base for said plurality of rolling means and located between each of said plurality of rolling means and said body;

at least one positioning means for maintaining said at least one rigid support means in substantially the same location on said body during rolling engagement with said surface; and at least one frictional engagement means for promoting, retarding or controlling rolling engagement of said article, wherein said at least one frictional engagement means has a higher coefficient of friction than any of the outer most surfaces of said article.

5. The article of claim 4, wherein said at least one frictional engagement means is located immediately adjacent to at least one of the hands, feet, head, shoulders and elbows of said body.

6. The article of claim 4, wherein said at least one frictional engagement means comprises a plurality of pads adjacent to one another, wherein at least one of said plurality of pads is a different size than at least one other of said plurality of pads.

7. The article of claim 4, wherein said at least one frictional engagement means can be removeably fastened to footwear worn by said body.

8. An article of clothing worn on a body comprising:

a plurality of rolling means for providing rolling engagement between the article and a surface not affixed to said article, wherein at least one of said plurality of rolling means is located immediately adjacent to at least one portion of said body that is closer to the head of said body than the legs of said body;

at least one rigid support means affixed to said plurality of rolling means providing a base for said plurality of rolling means and located between each of said plurality of rolling means and said body;

at least one positioning means for maintaining said at least one rigid support means in substantially the same location on said body during rolling engagement with said surface; and at least one cushion means affixed to said at least one rigid support means and located between said at least one rigid support means and said body for providing padding or increasing comfort to said body.

9. A first article of clothing worn on a body comprising:

a plurality of rolling means for providing rolling engagement between said first article and a surface not affixed to said first article, wherein at least one of said plurality of rolling means is located immediately adjacent to at least one portion of said body that is closer to the head of said body than the legs of said body;

at least one rigid support means affixed to said plurality of rolling means providing a base for said plurality of rolling means and located between each of said plurality of rolling means and said body;

at least one positioning means for maintaining said at least one rigid support means in substantially the same location on said body during rolling engagement with said surface; and at least one coupling for temporary engagement of at least a second article of clothing worn on a second body to said first article, wherein said coupling is at least partly located on an outer layers of said first article and said second article comprising another plurality of rolling means, at least one rigid support and at least one positioning means.

10. A body suit including;

at least one cushion pad located on the innermost surface of said body suit;

at least one rigid plate attached to said at least one cushion pad;

at least one roller bearing assembly attached to said rigid plate, which includes at least one multi-directional roller; and at least one outermost surface that is comprised of an elastic shell which conceals all other elements of said body suit except said at least one roller bearing assembly.

11. The body suit of claim 10, wherein said at least one roller bearing assembly is located adjacent to at least one of the chest, torso, pelvis, thighs, knees, upper back, lumbar, buttocks, head, shoulder, elbow and hip regions of a body wearing said body suit.

12. The body suit of claim 10, wherein said at least one roller bearing assembly is located adjacent to at least one of the upper back, lumbar and buttocks regions of a body wearing said body suit.

13. The body suit of claim 10, wherein said at least one roller bearing assembly is located adjacent to at least one of the chest, torso, and pelvis regions of a body wearing said body suit.

14. The body suit of claim 10, further comprising:

at least one friction pad for promoting, retarding or controlling rolling engagement of said body suit, wherein said at least one frictional pad have a higher coefficient of friction than any of the outer most surfaces of said body suit.

15. The body suit of claim 10, further comprising:

at least one protruding surface for temporary engagement with said body suit of at least one other body, wherein said at least one protruding surface is located on an outer layers of said body suit.

* * * * *